US007594306B2

(12) United States Patent
Beaulne et al.

(10) Patent No.: US 7,594,306 B2
(45) Date of Patent: Sep. 29, 2009

(54) CASKET LID

(75) Inventors: Gilles Beaulne, Blainville (CA); Normand Beauchesne, Victoriaville (CA)

(73) Assignee: Victoriaville Funeral Supplies Inc., Victoriaville, (Quebec) (CA)

( * ) Notice: Subject to any disclaimer, the term of this patent is extended or adjusted under 35 U.S.C. 154(b) by 355 days.

(21) Appl. No.: 11/270,514

(22) Filed: Nov. 10, 2005

(65) Prior Publication Data

US 2006/0101628 A1 May 18, 2006

Related U.S. Application Data

(60) Provisional application No. 60/626,875, filed on Nov. 12, 2004.

(51) Int. Cl.
*A61G 17/00* (2006.01)

(52) U.S. Cl. ..... 27/14

(58) Field of Classification Search ..... 27/14, 27/16, 17, 19, 2; 217/56, 57, 65; D99/12; 220/252

See application file for complete search history.

(56) References Cited

U.S. PATENT DOCUMENTS

| | | | | |
|---|---|---|---|---|
| 2,338,035 | A | 12/1943 | Gerold | |
| 3,735,457 | A | 5/1973 | Esterdahl | |
| 3,924,309 | A | 12/1975 | Andrus et al. | |
| 3,969,798 | A | 7/1976 | Sahlin | |
| 4,312,104 | A | 1/1982 | Baker et al. | |
| 4,639,985 | A | 2/1987 | Craft | |
| 4,730,370 | A | 3/1988 | Elder | |
| 4,967,455 | A | 11/1990 | Elder | |
| 4,972,891 | A | 11/1990 | Huber | |
| 5,035,032 | A | 7/1991 | Nutting | |
| 5,307,545 | A | 5/1994 | Stoltz | |
| 5,353,484 | A | 10/1994 | Woedl et al. | |
| 5,611,124 | A * | 3/1997 | Biondo et al. | 27/2 |
| 5,770,291 | A | 6/1998 | Tambussi | |
| 5,771,549 | A | 6/1998 | Saaf | |
| 5,862,874 | A | 1/1999 | Brienza et al. | |
| 5,960,978 | A | 10/1999 | Jenkins | |
| 6,094,789 | A | 8/2000 | Hankel et al. | |
| 6,238,327 | B1 | 5/2001 | Tambussi | |
| 6,243,931 | B1 | 6/2001 | Linville et al. | |
| 6,269,526 | B1 | 8/2001 | Bischoff et al. | |
| 6,503,429 | B1 | 1/2003 | Linville et al. | |
| 6,574,841 | B1 | 6/2003 | Vosahlik et al. | |
| 6,615,464 | B2 | 9/2003 | Tambussi | |
| 6,849,141 | B2 * | 2/2005 | Buchler et al. | 156/62.2 |
| 2001/0027592 | A1 | 10/2001 | Linville et al. | |
| 2003/0097739 | A1 | 5/2003 | Linville et al. | |
| 2003/0122280 | A1 | 7/2003 | Buchler et al. | |

FOREIGN PATENT DOCUMENTS

| | | |
|---|---|---|
| EP | 1113775 | 7/2001 |
| WO | WO 98/44886 | 10/1998 |
| WO | WO 00/15171 | 3/2000 |

* cited by examiner

*Primary Examiner*—William L. Miller
(74) *Attorney, Agent, or Firm*—Ogilvy Renault LLP; Dominique Pomerleau; Alexandre Daoust

(57) ABSTRACT

A casket lid includes a lid member with one of a male member and a female member, and at least one rim molding member having the other one of the male member and the female member. The male member and the female member are engaged for mounting the at least one rim molding member to the lid member.

12 Claims, 11 Drawing Sheets

CASKET LID

CROSS-REFERENCE TO RELATED APPLICATIONS

This application claims priority of U.S. provisional patent application 60/626,875 filed on Nov. 12, 2004, the specification of which is hereby incorporated by reference.

BACKGROUND OF THE INVENTION

1) Field of the Invention

The invention relates to burial or cremation caskets and, more particularly, to casket lids.

2) Description of the Prior Art

Caskets or coffins traditionally include a body container to which is pivoted a lid or a cap. The lid usually has a dome, a pie, a rim, and a header in the case of a split lid. The dome, or the crown, is often, though not necessarily, convex in shape. The pie, or the fishtail, is a pie-shaped section which fits into a pie-shaped cutout in one end of the dome. The dome and pie assembly is typically referred to in the industry as the "cover". The cover thus has opposed sides and opposed ends. Each of the opposed sides has a decorative piece of molding known as a side rim member secured thereto. Similarly, the pie has secured thereto a decorative piece of molding known as an end rim member. The pair of side and end rim members together define the rim or the ogee. The rim is mounted under the cover to form a raised lid.

In order to fabricate the lid, several different pieces must be time consumingly assembled and secured together. For example, in the case of wood caskets, the dome is typically formed from a plurality of boards secured together lengthwise with glue and/or fasteners. The pie is likewise formed from a plurality of boards and is secured to the dome with glue and/or fasteners. Next, the side and end rim members, themselves formed from a plurality of boards, are secured to the cover and the header, if any, again via glue and fasteners. The rim members are mounted inwardly of the cover to form a raised lid. As can be appreciated, manufacturing a casket lid is tedious and time consuming.

SUMMARY OF THE INVENTION

It is an object of the present invention to provide an efficient assembling method for casket lids.

One aspect of the invention provides a casket lid adapted to be mounted to a casket body container. The casket lid comprises a lid member and at least one rim member. The lid member and the at least one rim member are provided with corresponding male and female mating members. The male member and the corresponding female member are engaged for mounting the at least one rim member to the lid member.

Another aspect of the invention provides a casket lid comprising a lid member having a crown member bent into an arched shape; and at least one rim member mounted to the lid member with a groove and tongue engagement.

Another aspect of the invention provides a method to manufacture a casket lid. The method comprises: providing a lid member having one of a male member and a corresponding female member; providing at least one rim member having the other one of a male member and a corresponding female member; and engaging the male member and the corresponding female member for mounting the at least one rim member to the lid member.

A further aspect of the invention provides a method to manufacture a casket lid. The method comprises: arching a crown panel along a longitudinal axis of the crown panel, and reducing the spring-back of the arched crown panel by laminating a veneer with a wood grain pattern on a web panel forming the crown panel.

According to a general aspect, there is provided a casket lid adapted to be mounted to a casket body container. The casket lid comprises a lid member and at least one rim member, the lid member and the at least one rim member being provided with corresponding male and female mating members, the male member having an edge at least partly formed as an edge of the lid member, the female member having a groove at least partly provided as a longitudinal groove in the at least one rim member, and the male member and the corresponding female member being engaged for mounting the at least one rim member to the lid member with the edge of the lid member being securely received in the longitudinal groove.

According to a general aspect, there is provided a casket lid comprising a lid member having a crown member bent into an arched shape; and at least one rim member mounted to the crown member with a groove and tongue engagement, the at least one rim member having the groove and at least a section of a peripheral edge of the crown member being inserted into the groove.

According to a general aspect, there is provided a casket lid comprising a lid member having a crown member bent into an arched shape; and at least one rim member mounted to the crown member with a groove and tongue engagement, the crown member having two longitudinal edges; the lid member has a pie member extending between the two longitudinal edges of the crown member and having a transversal edge; and the at least one rim member has a transversal rim member and two longitudinal rim members, each one of the transversal and longitudinal rim members having an elongated groove therein; the longitudinal edges of the crown member being inserted into a respective one of the elongated grooves of the longitudinal rim members and the transversal edge of the pie member being inserted into the elongated groove of the transversal rim member.

According to a general aspect, there is provided a casket lid comprising a lid member having a crown member bent into an arched shape; and at least one rim member mounted to the crown member with a groove and tongue engagement, the crown member having a web and a veneer with a wood grain pattern laminated to the web.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figures 1, 1A:
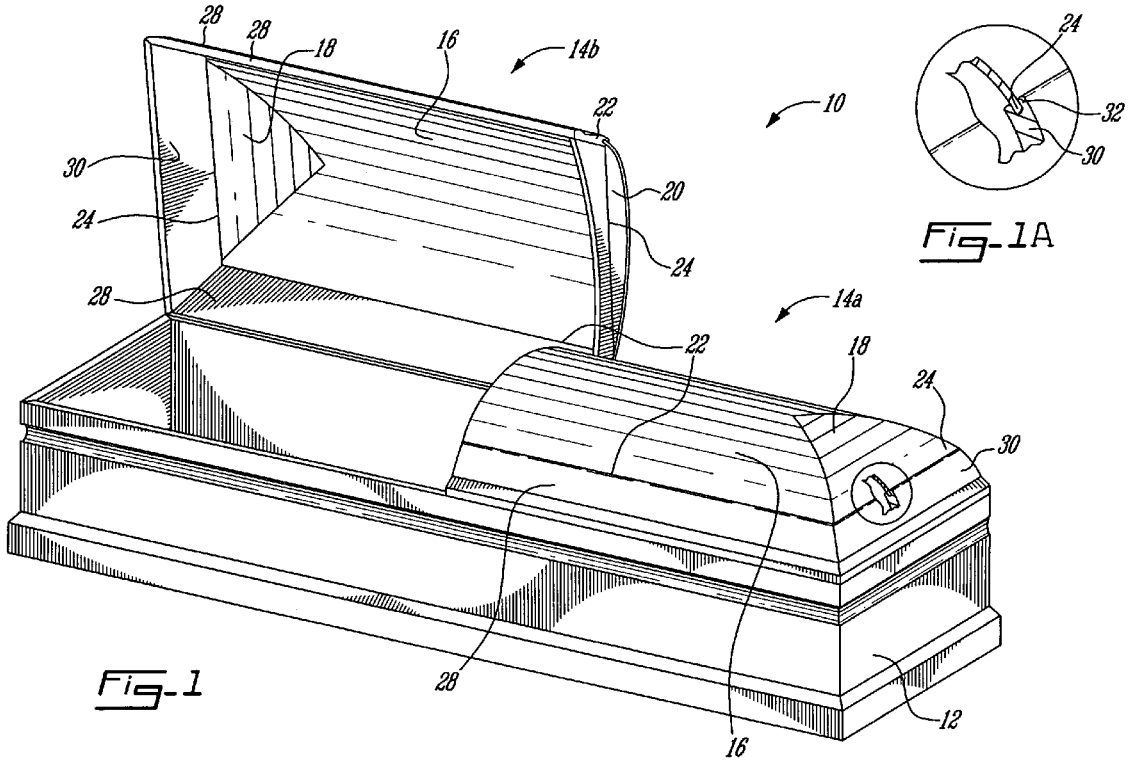
FIG. 1 is a perspective view of a casket having a body container and to which a split-lid is pivotally mounted.
FIG. 1A is a perspective view, fragmented and enlarged, of the connection between a cover and a rim of the split lid shown in FIG. 1 in accordance with an embodiment of the present invention.

Referring to the drawings and, more particularly, referring to FIG. 1, it will be seen that a casket 10 has a body container 12 and a split lid 14*a*, 14*b*, or a cap, pivotally mounted to the body container 12.

The lid can be either a one-piece lid 14 (FIG. 11) or a split lid, as shown, having two sections 14*a*, 14*b*. The lid 14 has an arched shape (or a convex shape). Each section 14*a*, 14*b* of the split lid has a dome 16 (or a crown), a pie 18 (or a fishtail), and a header 20 forming a cover having a pair of opposed longitudinal sides 22 and a pair of opposed transversal sides 24. The header 20 is positioned at the transversal side 24 opposed to the pie 18. A longitudinal rim 28 is mounted to each longitudinal side 22 of the cover. A transversal rim 30 is mounted to the transversal side 24 adjacent to the pie 18.

Referring to FIG. 1A, it will be seen that the transversal rims 30 have a slot 32 therealong and the transversal sides 24 of the pie 18 are inserted into these slots 32. Similarly, as it will be described more In details later, the longitudinal rims 28 also have a longitudinal slot 32 therealong and the longitudinal sides 22 of the cover are inserted into the slot 32. Therefore, assembling the rims 28, 30 and the cover to manufacture the lids 14 is faster and easier by creating slots 32, or grooves, into the rims 28, 30 and securely engaging the sides of the cover into these slots 32.

In another embodiment, one skilled in the art will appreciate that the slots can be created into the cover for allowing the rims 28, 30 to be securely engaged into these slots. A person skilled in the art will also appreciate that the slots and the edges can be replaced by any combination of male and female members.

The lid 14 can be produced from solid timber, craftwood, particleboards, fiberboards, agrifiber boards, a combination of these materials or any other material known to one skilled in the art. The lid 14 can be covered with a solid timber veneer or a paper veneer bearing a timber grain design or any other design.

Figure 2:
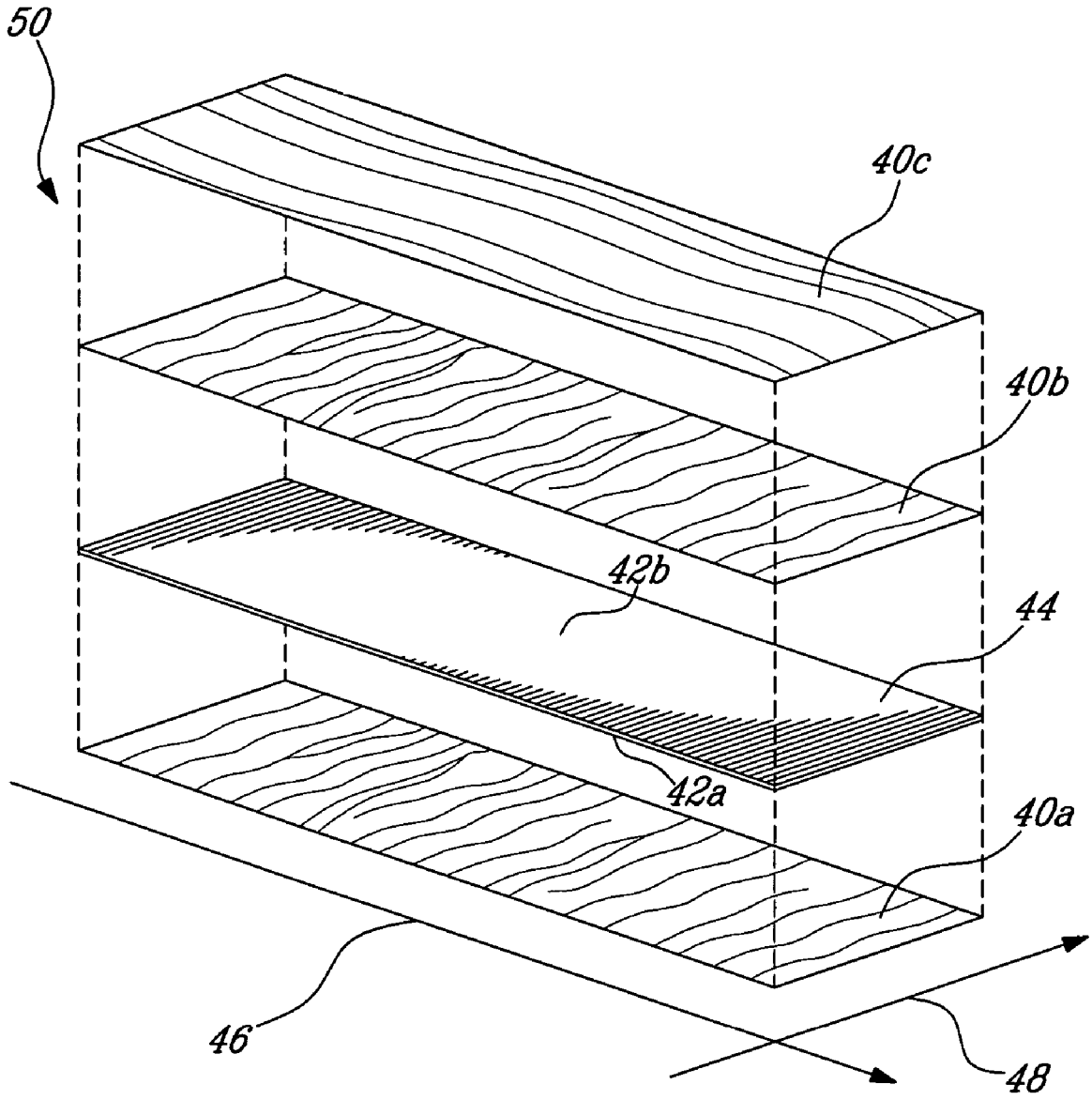
FIG. 2 is an exploded view of a crown panel for manufacturing the lid shown in FIG. 1 in accordance with an embodiment of the present invention.

Referring now to FIG. 2, it will be seen that for manufacturing the casket lid 14 in accordance with an embodiment of the invention, one or more veneers 40*a*, 40*b*, 40*c* are laminated on opposed faces 42*a*, 42*b* of a web 44 of a substantially rigid material. In the embodiment shown, the veneer 40*a* has wood grains along a transversal axis 48, perpendicular to the longitudinal axis 46 and is laminated on the face 42*a* of the web 44. The veneer 40*b* has wood grains along the transversal axis 48 and is laminated on the face 42*b* of the web 44. The veneer 40*c* has wood grains along the longitudinal axis 46 and is laminated over the veneer 40*b*. Two veneers 40*b*, 40*c* are laminated on the face 42*b* of the web 44 to reinforce the assembly formed by the web 44 and the veneers 40*a*, 40*b*, 40*c*, i.e. a crown panel 50.

An adhesive layer is applied between the veneers 40 and the web 44 to create a permanent bond therebetween. The adhesive can be a heat or pressure activated adhesive such as PVA (polyvynil acetates), yellow glue (aliphatic resin), urea resins, as it will be described in more details below.

A person skilled in the art will appreciate that any number of veneers 40 can be laminated on a respective face 42 of the web 44. Moreover, one or both faces 42 can be veneer-free. The wood grains can also be oriented differently than for the embodiment described. In an alternative embodiment, to reduce the manufacturing costs, the veneers 40 can be replaced with a cardboard panel (not shown), a MDF panel, a MDF panel laminated with a paper veneer, a paperbacked veneer, and the like.

The web 44 can be made of any appropriate material such as, without being limitative, particle boards such as MDF, agrifiber boards, cardboard, wood, etc. The veneers 42 can be wood veneers, paper veneers or any other appropriate material known to one skilled in the art. In an embodiment, the thickness of the web 44 varies between 1/16 to 1/2 of an inch and the thickness of the veneers 40 varies between 1/10 to 3/16 of an inch. A person skilled in the art will appreciate that the thickness of the web 44 and the veneers 40 can vary depending on the materials used.

Figure 3:
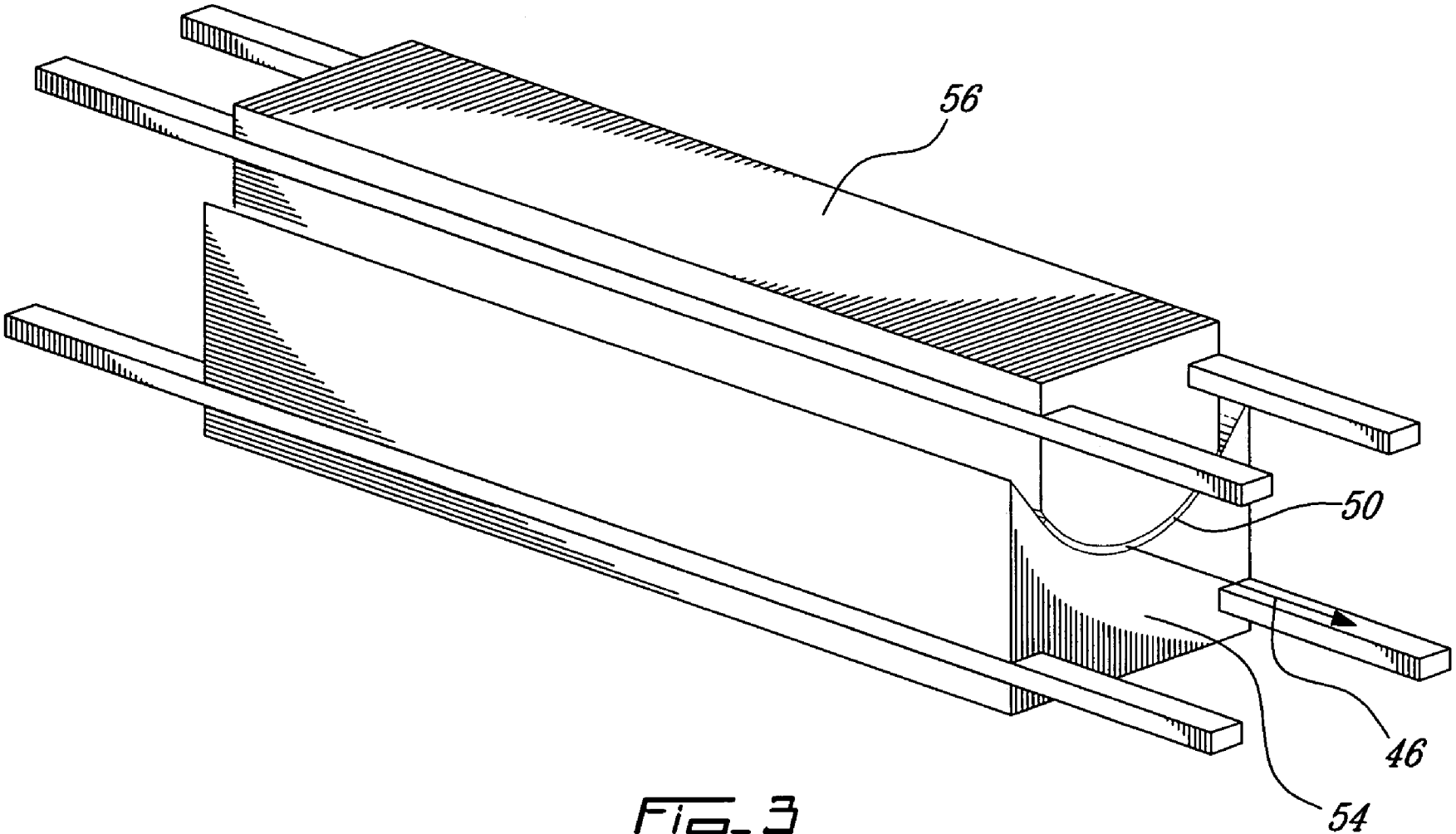
FIG. 3 is a perspective view of a male portion and a female portion of a bending press for bending the crown panel shown in FIG. 1.

Referring now to FIG. 3, there is shown that the crown panel 50 is bent into a convex shape along the longitudinal axis 46. For example, for shaping the crown panel 50, it can be disposed in a bending press (not shown) including a predetermined arch-shaped mold having a female portion 54 and a male portion 56. The crown panel 50 is then pressed between the female and male portions 54, 56 into the desired arched shape to form the arch-shaped crown or dome 16. The process parameters for bending the crown panel 50 vary in accordance with the thickness and the nature of the web 44 and veneers 40, if any. High frequencies can then be applied to fix the bending of the crown panel 50. The bending press can be a high frequency press, a membrane press, a cold press or any other type of press as can be appreciated by someone skilled in the art.

If a heat or pressure activated adhesive is used, the web 44 and veneers 40 assembly is reinforced after the bending process since the adhesive has been actuated.

Applying at least one veneer with wood grains, along one of the longitudinal axis 46 and the transversal axis 48, over one face 42 of the web 44 reduces the spring back effect of the crown panel 50 after the bending process. The spring back effect results in the modification of the crown panel radius after the bending process. Combined with the heat or pressure activated adhesive and at least one veneer 40 with the wood grains along the transversal axis 48, the spring back effect of the crown panel 50 is even more reduced.

A person skilled in the art will also appreciate that the veneers 40 and the web 44 can be bent independently and assembled after the bending step.

One skilled in the art will also appreciate that the crown panel 50 can be formed from a plurality of boards secured together and it can have a different shape than a convex shaped dome.

Figure 4:
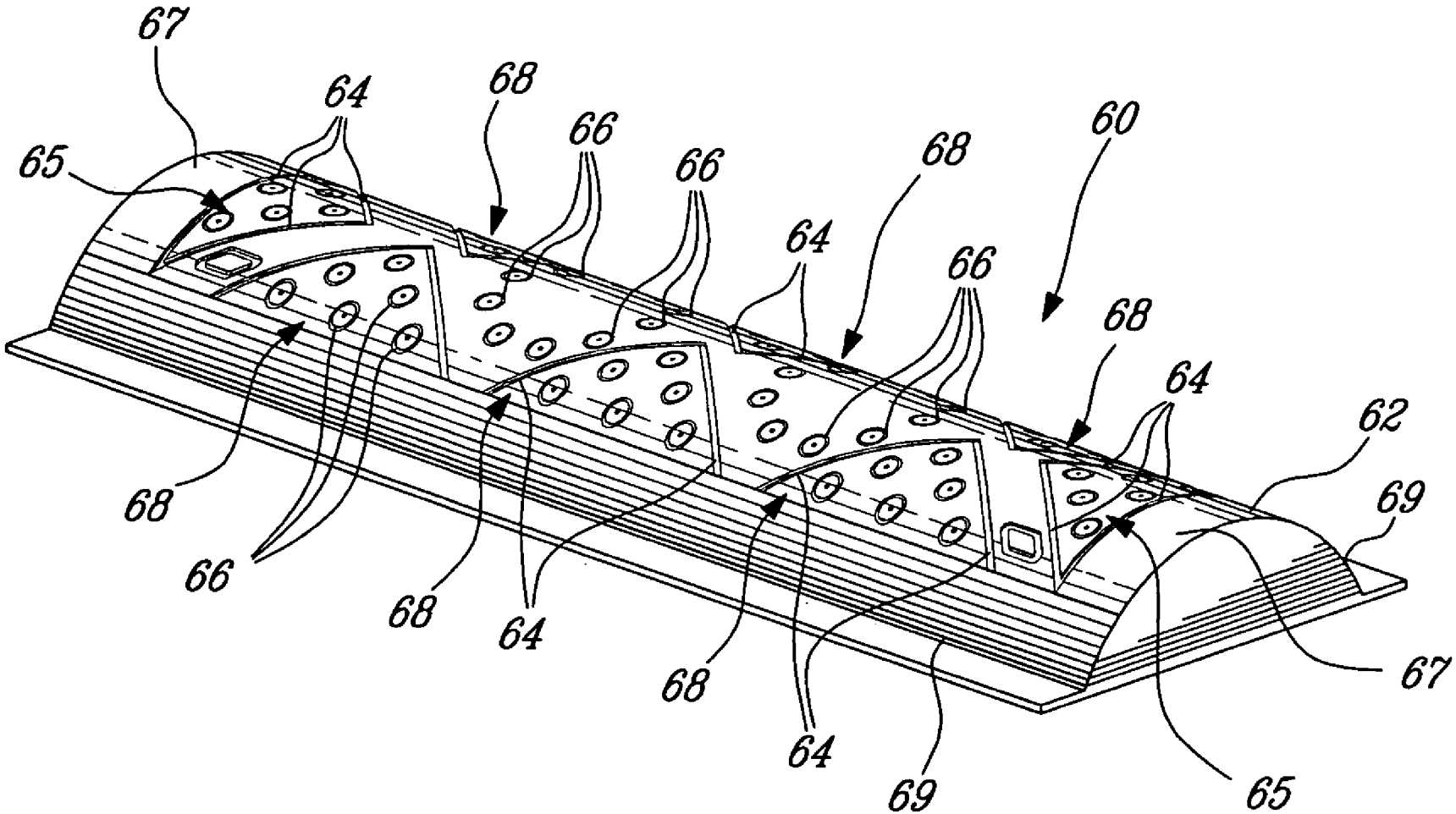
FIG. 4 is a perspective view of a template for cutting V-shaped sections at the ends of the arch-shaped crown panel in accordance with an embodiment of the present invention.
Figure 5:
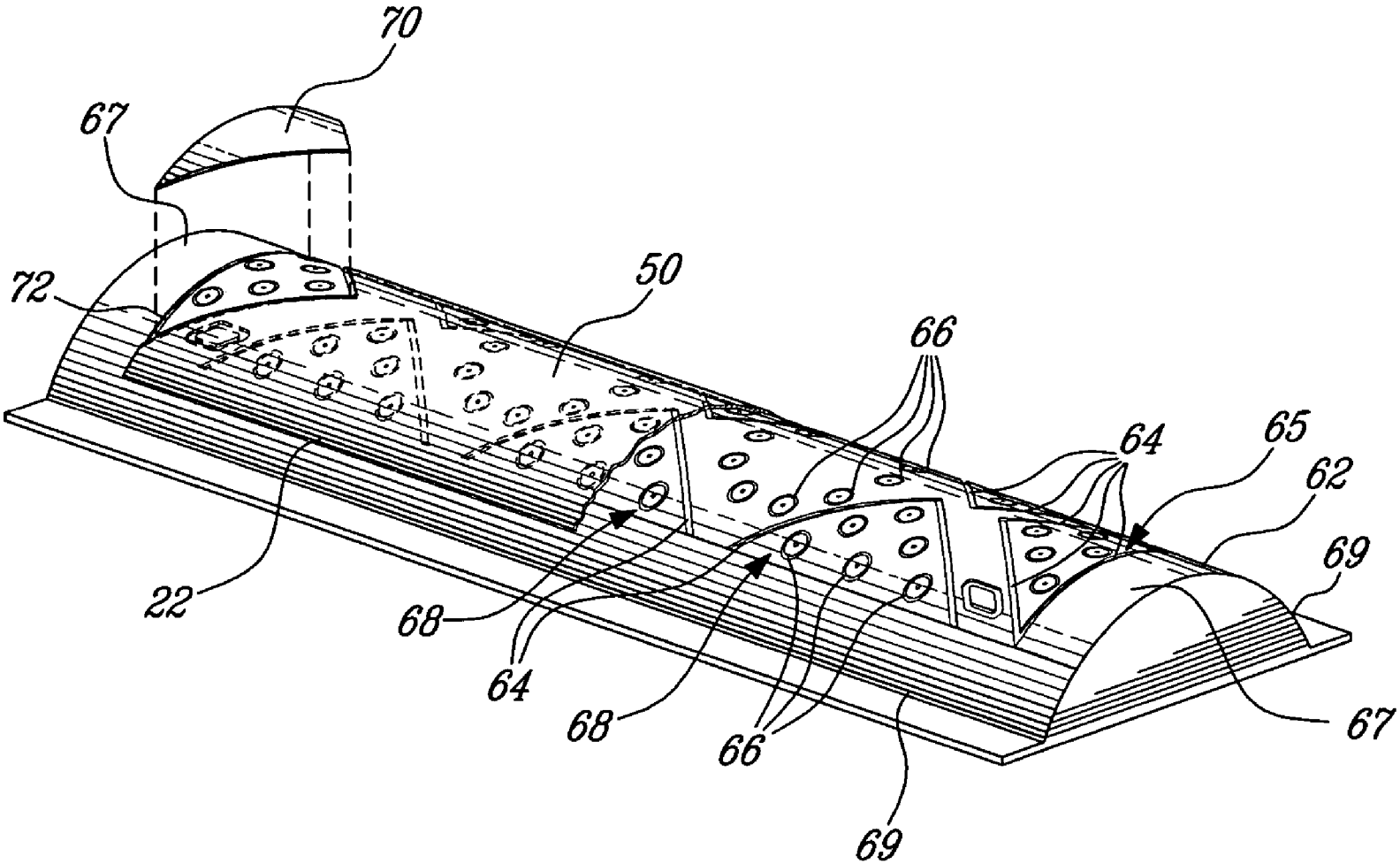
FIG. 5 is a perspective view of the template shown in FIG. 4 covered with a section of the arch-shaped crown panel with a pie-shaped cut-out at one end.

As shown in FIGS. 4 and 5, the crown panel 50 is disposed over a template 60. The template 60 has an arch-shaped outer face 62. The shape of the outer face 62 corresponds to the shape of the crown panel 50. The outer face 62 includes suction cups 66 operatively connected to a suction pump (not shown), or vacuum pump. When actuated, the suction cups 66 provide a suction, or partial vacuum, over the outer surface 62 and maintain the crown panel 50 in a fixed position over the template 60. The suction cups 66 are regularly disposed along the outer face 62. However, a person skilled in the art will appreciate that the suction cups 66 can be disposed in accordance with any appropriate pattern. Moreover, the vacuum means, preventing the crown panel 50 from moving relatively to the template 60, can differ from the one illustrated in FIG. 4. The suction cups 66 and the suction pump can also be replaced with mechanical fasteners.

Grooves 64 are provided along the outer face 62 of the template 60 and define cutting patterns for cutting sections of the crown panel 50. Two triangular-shaped cutting patterns 65 are provided at the ends 67 of the template 60. A plurality of triangular shaped cutting patterns 68 are also provided along the longitudinal edges 69 of the template 60. The purpose of the cutting patterns 65, 68 will be described in more details below. A person skilled in the art will appreciate that the disposition and the shape of the cutting patterns 65, 68 can differ from the one shown in FIG. 4.

Figure 6:
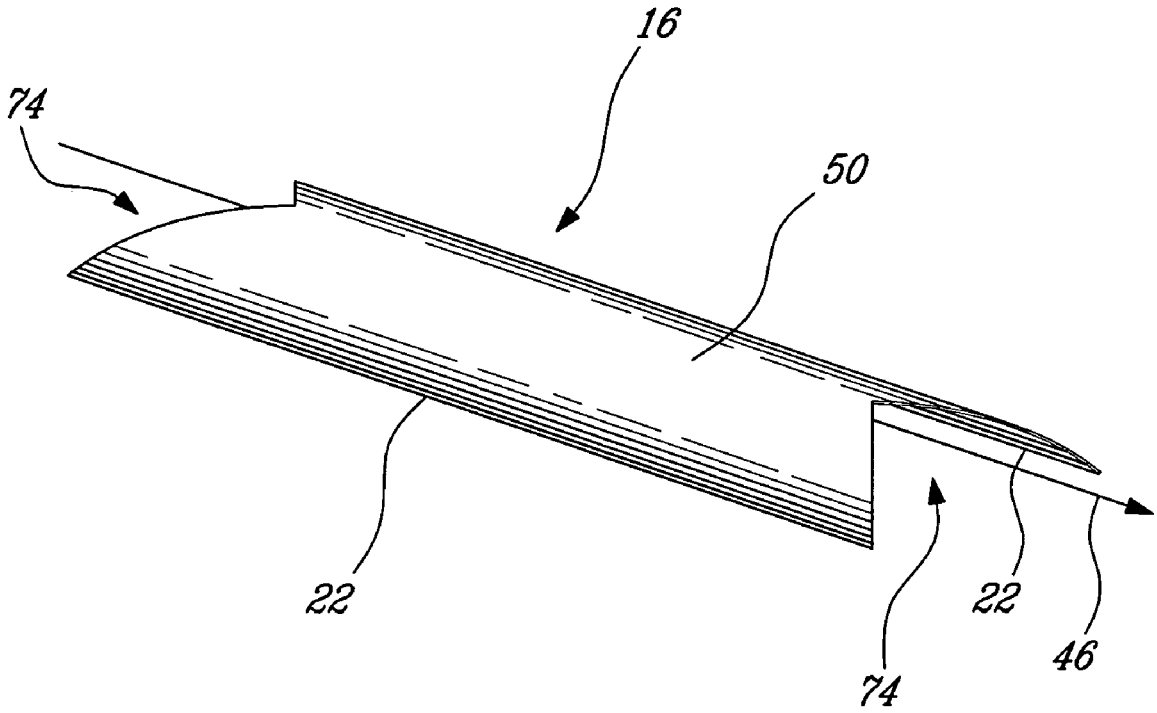
FIG. 6 is a perspective view of the dome with indentations (or pie-shaped cut-outs) at both ends in accordance with an embodiment of the present invention.

Referring now to FIG. 5, it will be seen that the crown panel 50 is disposed and maintained over the template 60 for cutting and removing V-shaped sections 70 (only one is shown) at each end 72 (only one is shown) of the crown panel 50. For cutting the V-shaped sections 70, the saw is aligned along the grooves 64 of the cutting patterns 65. Once the V-shaped sections 70 removed from the crown panel 50, two indentations 74, or recesses or pie-shaped cut-outs, are created in the crown panel 50, as shown in FIG. 6. The indentations 74 extend inwardly in the crown panel 50, between two ends of the longitudinal sides 22, or longitudinal edges, of the crown panel 50. The crown panel 50 with the indentations 74 define the dome 16 of the casket lid 14.

A person skilled in the art will appreciate that the shape of the indentations 74 can differ from the one shown in FIG. 5 and the shape of the cutting patterns 65 vary accordingly. Moreover, the indentations 74 can be created before bending the crown panel 50 or assembling the web 44 and the veneers 40 for creating the crown panel 50.

For a split lid 14*a*, 14*b*, the length of the dome 16 can be the length of a one-piece lid and the dome 16 is cut into two distinct pieces or the length of the dome 16 can be the length of the split lid 14*a* and only one indentations 74 is created at one end 72 of the dome 16. For a one-piece lid, two indentations 74 are created in the dome 16 at a respective end 72.

Figure 7:
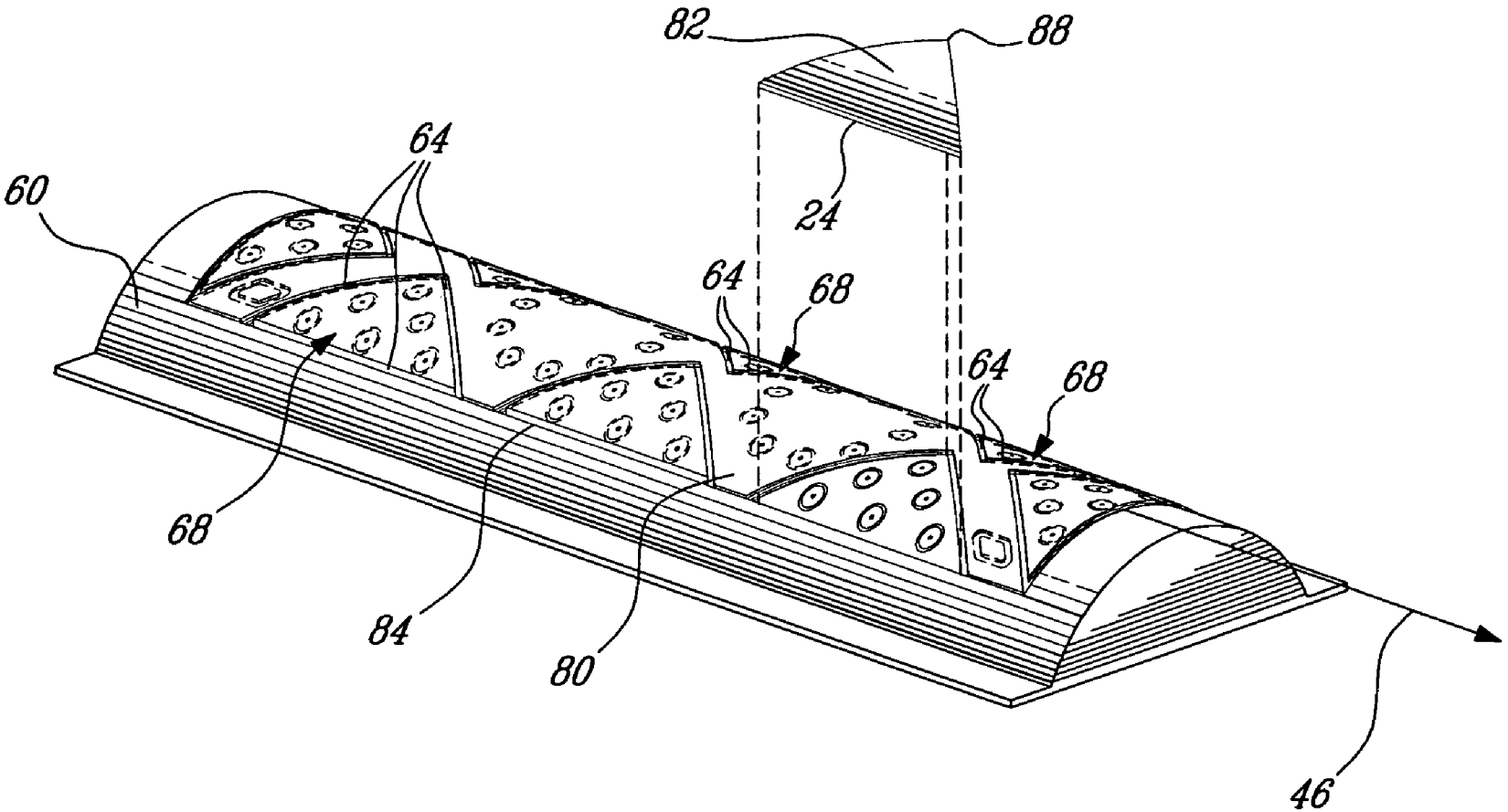
FIG. 7 is perspective view of the template shown In FIG. 4 covered with a second panel in accordance with an embodiment of the present Invention with a pie-shaped section cut therein.

As shown in FIG. 7, a second panel 80 is provided. The composition of the second panel 80 can be similar or different to the one of the crown panel 50. For example, the second panel 80 can be formed from a plurality of boards secured together. As the crown panel 50, the second panel 80 is also bent along the longitudinal axis 46. The same bending techniques as described above can be applied for the second panel 80. A person skilled in the art will appreciate that the second panel 80 can be an extension of the crown panel 50 which is removed from the latter before creating the indentations 74. As it will be described in more details below, the curvature of the second panel 80 is similar to the one of the crown panel 50.

The arch-shaped second panel 80 is disposed over the template 60. It will be appreciated that a different template than the one used for the crown panel 50 can be used. As for the crown panel 50, the template 60 prevents the second panel 80 from moving when the suction pump is actuated. Several V-shaped end members 82, or pie-shaped sections, are cut and removed along the longitudinal edges 84 of the second panel 80. For cutting the V-shaped end members 82, the saw is aligned along the grooves 64 of the cutting patterns 68. The number of V-shaped end members 82 cut and removed from the second panel varies in accordance with the length of the second panel 80 and the template 60 used.

In summary, the V-shaped end members 82 are cut on the longitudinal sides 84 of the second panel 80 which are straight while the V-shaped sections 70 are cut at the ends 72 of the crown panel 50 which are bent. A person skilled in the art will appreciate that the transversal rims 30, if any, can be mounted to the longitudinal sides of the second panel 80 before cutting the end members 82 therein. Similarly, the longitudinal rims 32, if any, can be mounted to the longitudinal edges 22 of the crown panel 50 creating the indentations 74 at the ends 72.

Each end member 82 has a transversal edge 24, which correspond to a section of one of the longitudinal edges 84 of the second panel 80, and a summit 88, opposed to the transversal edge 24. The shape of the end members 82 corresponds to the shape of the indentations 74 in the dome 16. Therefore, if the shape of the indentations 74 differ from the shape of a pie-shaped cut-out, the shape of the end members 82 vary accordingly. The length of the transversal edge 24 corresponds to the distance between the ends of the longitudinal edges 22 of the dome 16. Moreover, since the second panel 80 and the dome 16 have the same curvature, the edges of the end members 82 mate with the edges of the dome 16 defining the indentations 74. The end members 82 form the pies 18 of the lid 14.

Figure 8:
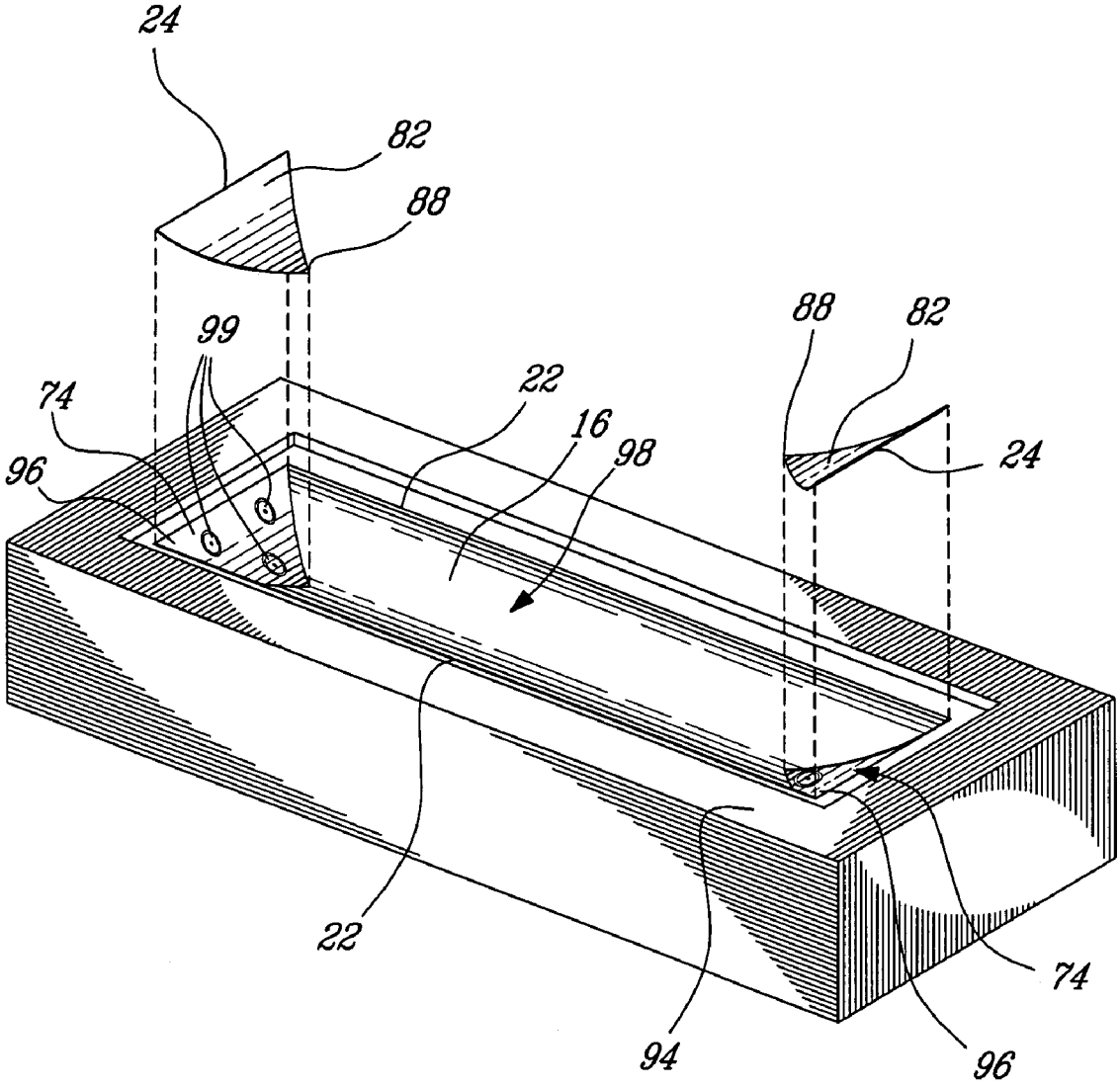
FIG. 8 is a perspective view of a second template in accordance with an embodiment of the present invention having the dome with indentations at both ends disposed therein and pie-shaped sections being inserted in the indentations.
Figure 9:
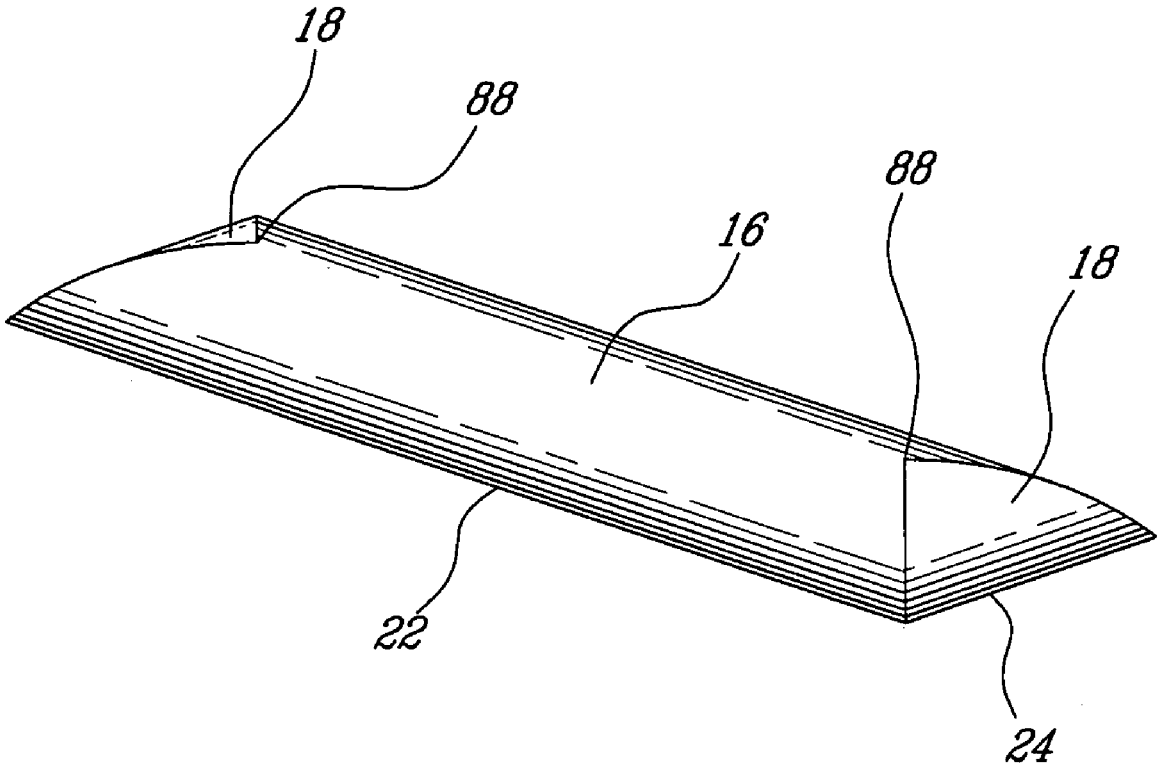
FIG. 9 is a perspective view of the dome shown in FIG. 6 with pie-shaped sections mounted into the indentations.

Referring now to FIG. 8, it will be seen that the dome 16 with the inwardly extending indentations 74 is disposed into a second template 94. The second template 94 has an outer face 96 defining a cavity 98. The shape of the cavity 98 corresponds to the shape of the cover (dome 16 with pies 18). A person skilled in the art will appreciate that it can correspond to the shape of the lid 14 (cover with rims), as will be described in more-details below.

In the cavity 98, the outer face 96 of the template 94 includes suction cups 99 operatively connected to a suction pump (not shown), or vacuum pump. When actuated, the suction cups 99 provide a suction, or partial vacuum, in the cavity 98 and maintain the dome 16 and the pies 18 (or end members 82), as it will be described in more details below, in a fixed position in the cavity 98. As for the template 60, the suction cups 99 can be disposed in accordance with any appropriate pattern in the cavity 98. Moreover, the vacuum means, preventing the dome 16 and the pies 18 from moving inside the cavity 98, can differ from the one illustrated in FIG. 4. For example, the suction cups 99 and the suction pump can be replaced with mechanical fasteners.

Then, two pies 18 (or end members 82) are respectively inserted into the indentations 74 of the dome 16, disposed In the template 94, and secured thereto. When the vacuum pump is actuated, the pies 18 and the dome 16 remain in a predetermined position relatively to one another. Once the pies 18 and the dome 16 juxtaposed, they are secured together with an adhesive, fasteners, or any appropriate technique known to those skilled in the art while being maintained together in the template 94.

A person skilled in the art will appreciate that the assembling of the end members 82 (or pies 18) with the dome 16 can be carried out without using the template 94, with any other appropriate means. If the template 94 is used, it can differ from the above described embodiment. For example, it can be free of suction cups 99 or the suction cups 99 can be replaced by any other means preventing the dome 16 from moving while assembling the pies 18 thereto.

Figure 10:
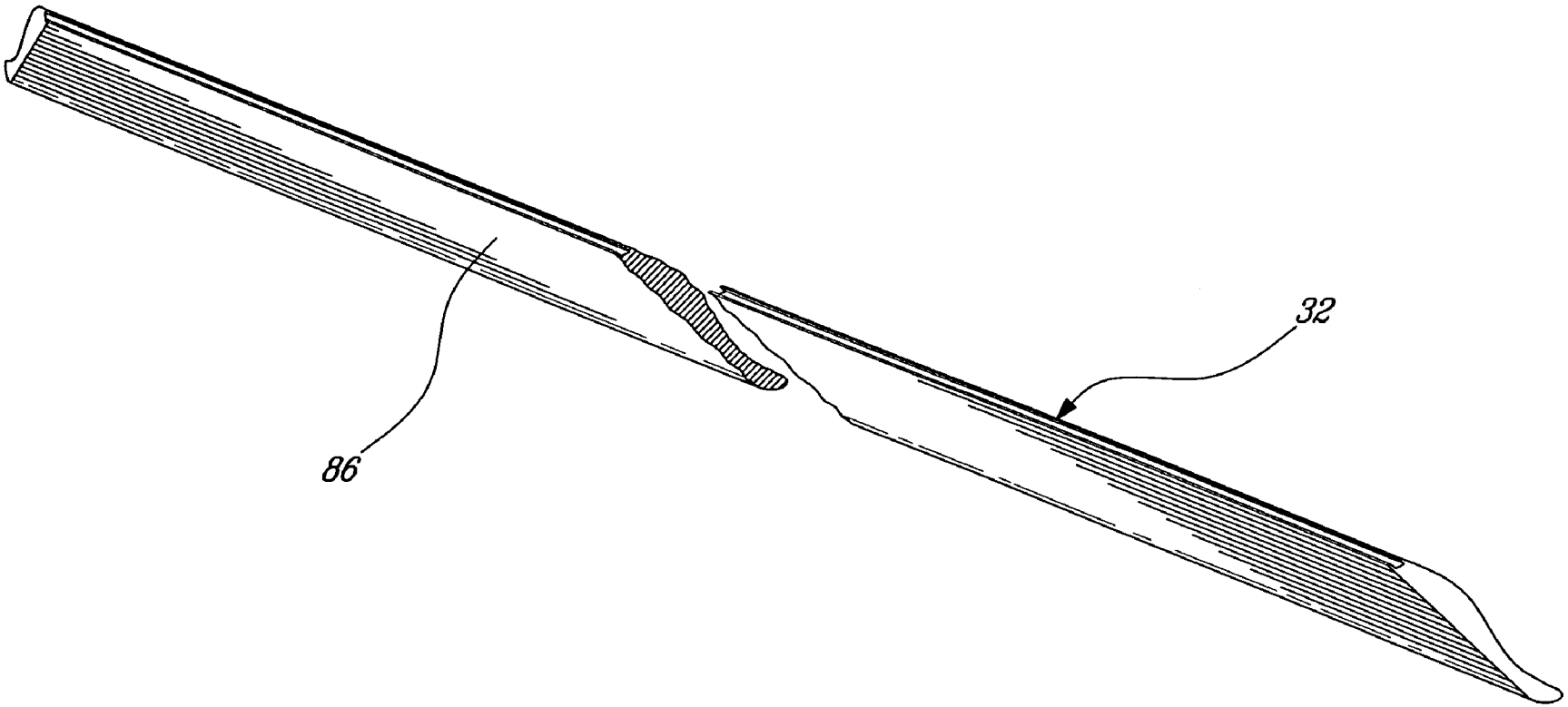
FIG. 10 is a perspective view, fragmented, of a rim member having an elongated groove in accordance with an embodiment of the present invention.
Figure 11:
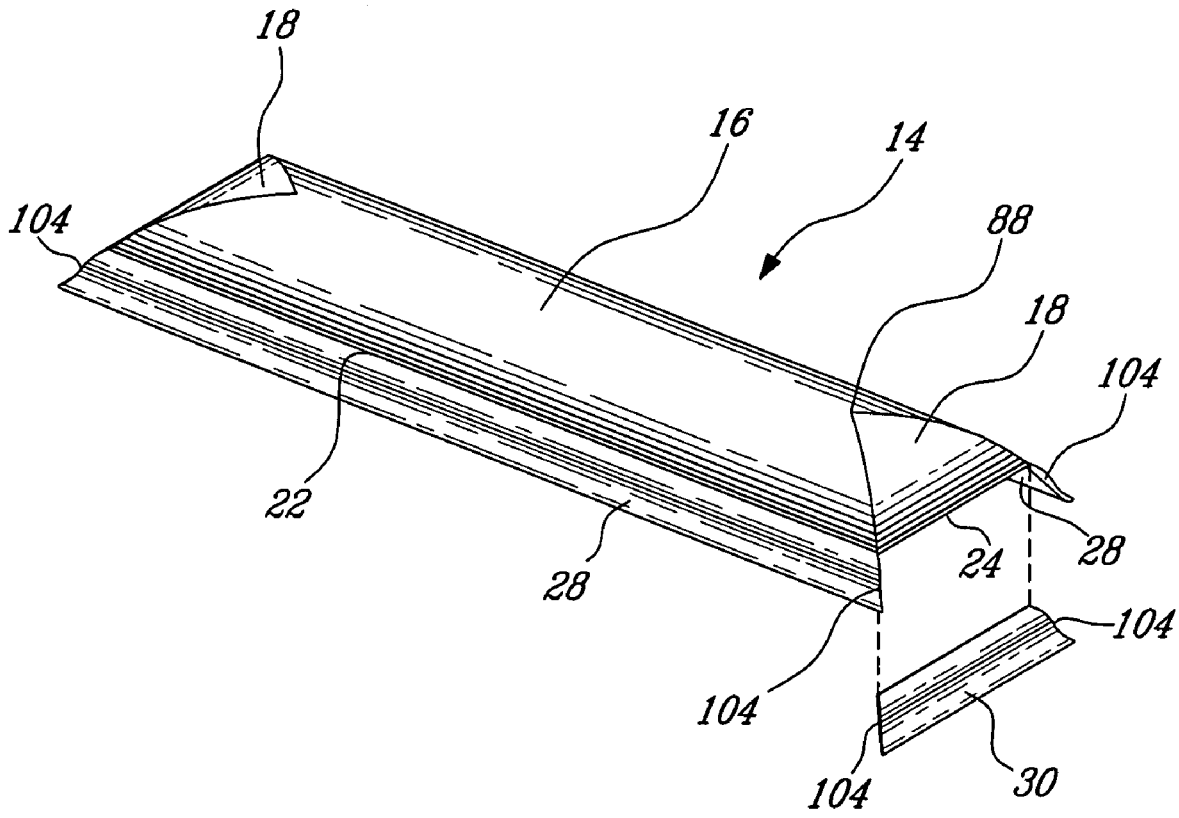
FIG. 11 is a perspective view of the dome shown In FIG. 10 with the rims shown in FIG. 10 being mounted thereto.

Referring simultaneously to FIGS. 10 and 11, it will be seen that a rim member 86 is provided. With any appropriate technique known to one skilled in the art, a longitudinally extending slot 32, or groove, is provided in the rim member 86. The width of the longitudinal slot 32 is sufficient to insert respectively the longitudinal edges 22 of the dome 16 and the transversal edge 24 of the pies 18. The rim member 86 is cut into several rims 28, 30, each having a length corresponding either to the length of a longitudinal rim 28 or to the length of a transversal rim 30. The ends 104 of the longitudinal rims 28 and the transversal rims 30 are beveled edges for mating the corresponding beveled edges of a juxtaposed rim 28, 30 when mounted to the dome 16 or the pie 18, as it will be described in more details below.

The longitudinal and transversal rims 28, 30 can be molded, can be formed from a plurality of boards secured together, can be made from wood, MDF or any other material shaped from a mechanical molding machine. Moreover, the rims 28, 30 can have a different shape than the rim members shown in FIGS. 10 and 11.

A person skilled in the art will appreciate that the longitudinal slot 32 can be performed in each rim 28, 30 before or after cutting the ends of the rim 28, 30 into beveled edges.

The longitudinal edges 22 of the dome 16 are inserted into the slot 32 of a respective longitudinal rim 28 and the transversal edges 24 of the pies 18 are inserted into the slot 32 of a respective transversal rim 30. Once inserted, they are secured together with an adhesive, fasteners, or any appropriate technique known to those skilled in the art.

It will appreciate that the rims 28, 30 can be mounted to the crown panel 50 and the second panel 80, either before bending the later or cutting the V-shaped sections 70 and the end members 82. Therefore, if the rims 28, 30 are mounted to the crown panel 50 and the second panel 80, the beveled edges 104 of the rims 28, 30 are created simultaneously when cutting the V-shaped sections 70 and the end members 82.

A person skilled in the art will appreciate that the template 94 can differ from the shown in FIG. 8. For example, the cavity 98 can be adapted to receive simultaneously the dome 16, the pies 18, and the rims 28, 30. Therefore, the assembling of the rims 28, 30 and the dome 16 and the pies 18 can be carried out in the template 94.

As mentioned above, for a split lid 14*a*, 14*b*, the one-piece lid thus obtained can be cut into two distinct pieces. A header 20 can be mounted to each section 14*a*, 14*b* of the split lid, at the end opposed to the pie 18. In the alternative, the same manufacturing process can be applied to manufacture independently each section 14*a*, 14*b* of the split lit.

As shown in FIGS. 1 and 11, the appearance of the lid 14 manufactured with the above-described technique differ from the appearance of the prior art lids.

Instead of securing together a plurality of boards to form the dome 16 and the pie 18, the lid 14 is made from two panels bent into an arched shaped. The panels 50, 80 are thinner than the boards assembled for forming the dome 16 and the pie 18. Therefore, the resulting cover is thinner.

Instead of mounting the rim (or the ogee) under the cover to form a raised lid, the peripheral edges 22, 24 of the cover are inserted into the longitudinal slot (or a groove) 32 of the rim members 32, 34. Therefore, the rims 32, 34 are not mounted under the cover but a section of the cover is inserted into the rims 32, 34, providing a distinct appearance to the resulting lid 14.

The groove and tongue engagement between the edges of the lid 14 and the rims 32, 34 is possible since the lid 14, made from arch-shaped panels 50, 80, is thinner and lighter than the prior art casket lids made from a plurality of relatively thick boards.

Less manufacturing time and steps are required to manufacture lids with the above described technique. Consequently, less manpower is required to manufacture the lids.

One skilled in the art will appreciate that the lid 14 can differ from the one of the embodiment described hereinabove. For example, it can have a unique lid design or can have a basic design such as a flat lid.

The embodiments of the invention described above are intended to be exemplary only. It will be appreciated that the assembly of the rim and the cover using a combination of male and female members can be carried out with any types of casket lids and not necessarily with lids manufactured with bent panels. For example, it can be applied to flat casket lids or casket lids manufacture by securing together a plurality of boards. Moreover, the cover can include the female member and the rims can include the corresponding male member, especially if the cover is relatively thick. The scope of the invention is therefore intended to be limited solely by the scope of the appended claims.

What is claimed is:

1. A casket lid adapted to be mounted to a casket body container, the casket lid comprising a lid member and at least one rim member, the lid member and the at least one rim member being provided with corresponding male and female mating members, the male member having an edge at least partly formed as an edge of the lid member, the female member having a groove at least partly provided as a longitudinal groove in the at least one rim member, and the male member and the corresponding female member being engaged for mounting the at least one rim member to the lid member with the edge of the lid member being securely received in the longitudinal groove of the at least one rim member; wherein the lid member comprises a dome with two longitudinal edges and a pie mounted to the dome and extending between the two longitudinal edges of the dome, and the at least one rim member comprises two longitudinal rim members and a transversal rim member; a transversal edge of the pie being inserted into the longitudinal groove of the transversal rim member and the longitudinal edges of the dome being inserted into the respective longitudinal groove of the longitudinal rim members.

2. A casket lid as claimed in claim 1, wherein the lid member has an inner face and an outer face and the longitudinal groove divides the at least one rim member into an outer portion and an inner portion, the outer portion being juxtaposed to the outer face of the lid member and the inner portion being juxtaposed to the inner face of the lid member.

3. A casket lid as claimed in claim 1, wherein an end of the longitudinal rim members is juxtaposed to an end of the transversal rim member and both ends are complementary beveled edges.

4. A casket lid as claimed in claim 1, wherein the lid member has an arched shape.

5. A casket lid comprising a lid member having a crown member bent into an arched shape; and at least one rim member mounted to the crown member with a groove and tongue engagement, the at least one rim member having the groove and at least a section of a peripheral edge of the crown member being inserted into the groove; wherein the crown member comprises two longitudinal edges; the lid member comprises a pie member extending between the two longitudinal edges of the crown member and having a transversal edge; and the at least one rim member comprises a transversal rim member and two longitudinal rim members, each one of the transversal and longitudinal rim members having an elongated groove therein; the longitudinal edges of the crown member being inserted into a respective one of the elongated grooves of the longitudinal rim members and the transversal edge of the pie member being inserted into the elongated groove of the transversal rim member.

6. A casket lid as claimed in claim 5, wherein the transversal rim member has two opposed beveled ends, each beveled end being juxtaposed to a complementary beveled end of a respective longitudinal rim member.

7. A casket lid as claimed in claim 5, wherein the crown member comprises a web and a veneer with a wood grain pattern laminated to the web.

8. A casket lid as claimed in claim 7, wherein the wood grain pattern of the veneer is along a transversal axis of the crown member.

9. A casket lid comprising a lid member having a crown member bent into an arched shape; and at least one rim member mounted to the crown member with a groove and tongue engagement, the crown member having two longitudinal edges; the lid member has a pie member extending between the two longitudinal edges of the crown member and having a transversal edge; and the at least one rim member has a transversal rim member and two longitudinal rim members, each one of the transversal and longitudinal rim members having an elongated groove therein; the longitudinal edges of the crown member being inserted into a respective one of the elongated grooves of the longitudinal rim members and the transversal edge of the pie member being inserted into the elongated groove of the transversal rim member.

10. A casket lid as claimed in claim 9, wherein the transversal rim member has two opposed beveled ends, each beveled end being juxtaposed to a complementary beveled end of a respective longitudinal rim member.

11. A casket lid as claimed in claim 9, wherein the crown member comprises a web and a veneer with a wood grain pattern laminated to the web.

12. A casket lid as claimed in claim 11, wherein the wood grain pattern of the veneer is along a transversal axis of the crown member.

* * * * *

UNITED STATES PATENT AND TRADEMARK OFFICE

CERTIFICATE OF CORRECTION

PATENT NO. : 7,594,306 B2
APPLICATION NO. : 11/270514
DATED : September 29, 2009
INVENTOR(S) : Beaulne et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 678 days.

Signed and Sealed this

Twenty-eighth Day of September, 2010

David J. Kappos

David J. Kappos
*Director of the United States Patent and Trademark Office*